US006593515B2

(12) United States Patent
Hirayama et al.

(10) Patent No.: US 6,593,515 B2
(45) Date of Patent: Jul. 15, 2003

(54) REINFORCING STRUCTURE FOR THE NECK PORTION OF STRINGED INSTRUMENT

(75) Inventors: Shinjiro Hirayama, Aichi (JP); Tatsuru Shimooka, Nagoya (JP)

(73) Assignee: Hoshino Gakki Kabushiki Kaisha (JP)

( * ) Notice: Subject to any disclaimer, the term of this patent is extended or adjusted under 35 U.S.C. 154(b) by 0 days.

(21) Appl. No.: 10/125,304

(22) Filed: Apr. 17, 2002

(65) Prior Publication Data

US 2003/0000365 A1 Jan. 2, 2003

(30) Foreign Application Priority Data

Jun. 29, 2001 (JP) ..... 2001-198573

(51) Int. Cl.[7] ..... G10D 3/00
(52) U.S. Cl. ..... 84/293
(58) Field of Search ..... 84/293, 290

(56) References Cited

U.S. PATENT DOCUMENTS

| | | | | |
|---|---|---|---|---|
| 4,074,606 A | | 2/1978 | Fender | 84/293 |
| 4,084,476 A | * | 4/1978 | Rickard | 84/293 |
| 4,237,944 A | * | 12/1980 | Todd et al. | 144/350 |
| 4,528,886 A | * | 7/1985 | Fender | 84/293 |
| 4,557,174 A | | 12/1985 | Gressett, Jr. | 84/293 |
| 4,681,009 A | | 7/1987 | Mouradian | 84/293 |
| 4,759,250 A | * | 7/1988 | Lieber | 84/293 |
| 5,696,334 A | | 12/1997 | Terry | 84/293 |
| 5,864,073 A | | 1/1999 | Carlson | 84/293 |
| 5,965,830 A | | 10/1999 | Carlson | 84/293 |
| 6,051,765 A | | 4/2000 | Regenberg et al. | 84/293 |
| 6,111,175 A | | 8/2000 | Lasner | 84/293 |
| 6,399,862 B1 | * | 6/2002 | Wilfer | 84/293 |

FOREIGN PATENT DOCUMENTS

| | | |
|---|---|---|
| JP | 1-202795 | 8/1989 |
| JP | 2001-13957 | 1/2001 |

* cited by examiner

*Primary Examiner*—Kimberly Lockett
(74) *Attorney, Agent, or Firm*—Ostrolenk, Faber, Gerb & Soffen, LLP

(57) ABSTRACT

A stringed instrument has a body, a longitudinal neck attached to the body and extending therefrom, and strings extending between the body and a free head end of the neck, the strings attached so that they generate a tensile force tending to deform the neck. To prevent deformation of the neck, it receives a rigid reinforcing body provided with a groove that extends from a first end of the body and terminates at a distance from the opposite second end, so that the rigid body has a grooveless end region and a grooved end region. The grooved end faces the body of the stringed instrument. The grooveless end region and an upper part of the grooved end region are fixed to the top side of the instrument neck along their entire lengths, whereas a lower part of the grooved end region is detachably secured to the neck and generates a force counteracting the tensile force to minimize the deformation of the neck.

18 Claims, 8 Drawing Sheets

REINFORCING STRUCTURE FOR THE NECK PORTION OF STRINGED INSTRUMENT

FIELD OF THE INVENTION

This invention relates to a stringed instrument, and particularly to reinforcing a structure preventing the neck of the stringed instrument from deforming.

BACKGROUND OF THE INVENTION

A stringed instrument ordinarily has a body, a neck which is joined to the body and a head at the top of the neck, with at least one string and usually a plurality of strings stretched between a bridge on the body and a respective peg nut for each string which is typically on the head. The strings produce a tensile force between the peg nut and the bridge which causes upward deformation of the neck. A bent neck prevents production of correct musical intervals or it becomes difficult to reach the high positions toward the body end of each string, that is the end located close to the body. As the strength of the neck is low, a longer time will be required for the correct intervals to be obtained as the neck part is gradually deformed at the time of tuning.

To cope with the above discussed problem, it is known to place a truss rod having a bar-shaped iron core in the neck. This improves the strength of the neck by providing a repulsive force which counteracts forces tending to bend the neck.

Another known structure of a stringed instrument has a strong wooden material known as bubinga, which is held at the center of the neck. Alternatively, a metal plate having a convex shape is buried in the neck as a reinforcing material, as described in the Official Publication of Toku Kai 2001 13957.

In recent years, however, there has been an increasing demand for reduction of the size and particularly the thickness of the neck, particularly of guitars. This has made it increasingly difficult to place various reinforcing materials and structures, as described above, in the neck of the stringed instrument. Furthermore, the stringed instrument as a whole requires a simple reinforcing structure for the neck.

SUMMARY OF THE INVENTION

The invention has the object of overcoming the above described problems. A reinforcing structure for the neck of a stringed instrument, according to the invention, has an extremely simple structure which provides the neck with high strength and increased resistance to bending forces acting upon the neck.

In addition, the reinforcing structure for the neck of the invention allows bending of the neck to be adjusted and corrected.

In one embodiment of the invention, the reinforcing structure for the neck of a stringed instrument comprises a longitudinally extending, rigid, preferably plate, bar-shaped body extending along the longitudinal direction of the neck and disposed under a finger plate on the top side of the neck. The bar-shaped body has a cut groove which extends from the instrument body end of the bar shaped body toward the instrument head end of the bar shaped body. The plate bar-shaped body is divided into a head-side grooveless portion, a body-side groove upper portion and a body-side groove lower portion which are separated by the groove. The head-side grooveless portion and the body-side groove upper portion are bound securely along the entire length of the bar-shaped body to the underside of the top side of the neck, and, particularly to the underside of the finger board, and the body-side groove lower portion is detachably secured to the neck only at a location toward the instrument body end, i.e. the open groove end.

In another embodiment of the invention, the reinforcing structure for the neck of a stringed instrument has a plate bar-shaped body which is formed approximately in the form of U as viewed in a plane parallel to the top side of the neck and including a plate bar on the right side and a plate bar on the left side joined by a grooved body end connector. Therefore, the groove extends through the body end connector and into both of the right and left side bars from their instrument body ends toward their instrument head ends.

As a further feature of the invention, the terminal positions of cut grooves formed in the right-side plate bar and left-side plate bar may be the same distance into the bars from their body ends or may be different distances into the bodies from those ends because the different strings across the neck apply different upward bending forces on the neck.

A further feature of the invention relates to a reinforcing structure for the neck of a stringed instrument having tensile means that pulls the body-side lower part toward the body of the stringed instrument for generating thereby a force which counteracts tensile forces tending to deform the neck.

DETAILED DESCRIPTION OF EMBODIMENTS OF THE INVENTION

Figure 1:
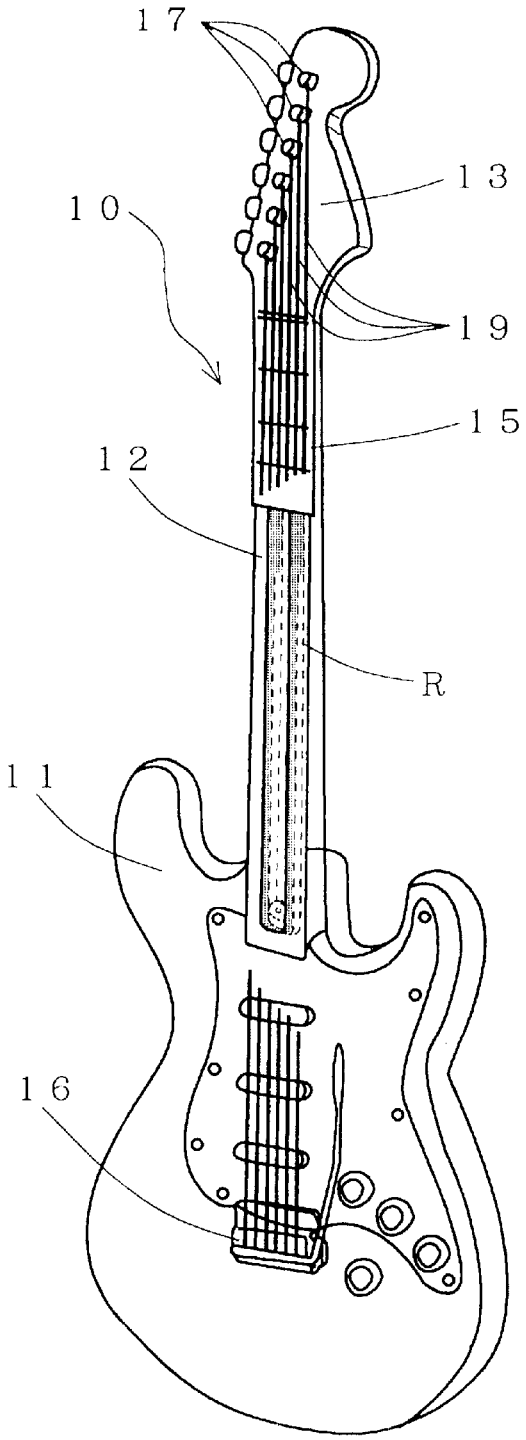
FIG. 1 is an isometric view of an electric guitar in an example of this invention, with a part of the neck removed.

An electric guitar 10 is an example of a stringed instrument in which the invention is provided. The guitar 10 includes a body 11, a neck 12 extending above the top of the body, a head 13 at the end of the neck, a finger plate 15 applied to the upper side of the neck 12 to define the top side of the neck, a bridge 16 on the top of the body, peg nuts 17 on the head for each of the strings 19 and the strings extend back to the bridge. For the purpose of illustration, a part of the length of the strings 19 and the finger plate 15 are cut out in FIG. 1.

A neck reinforcing structure according to the invention comprises a plate bar-shaped generally rigid body R buried or mounted in and extending along the longitudinal direction of the neck 12 below the finger plate 15 on the neck. It is able to bend only slightly under tensile forces applied by the strings extending between the bridge and the peg nuts.

Figure 2:
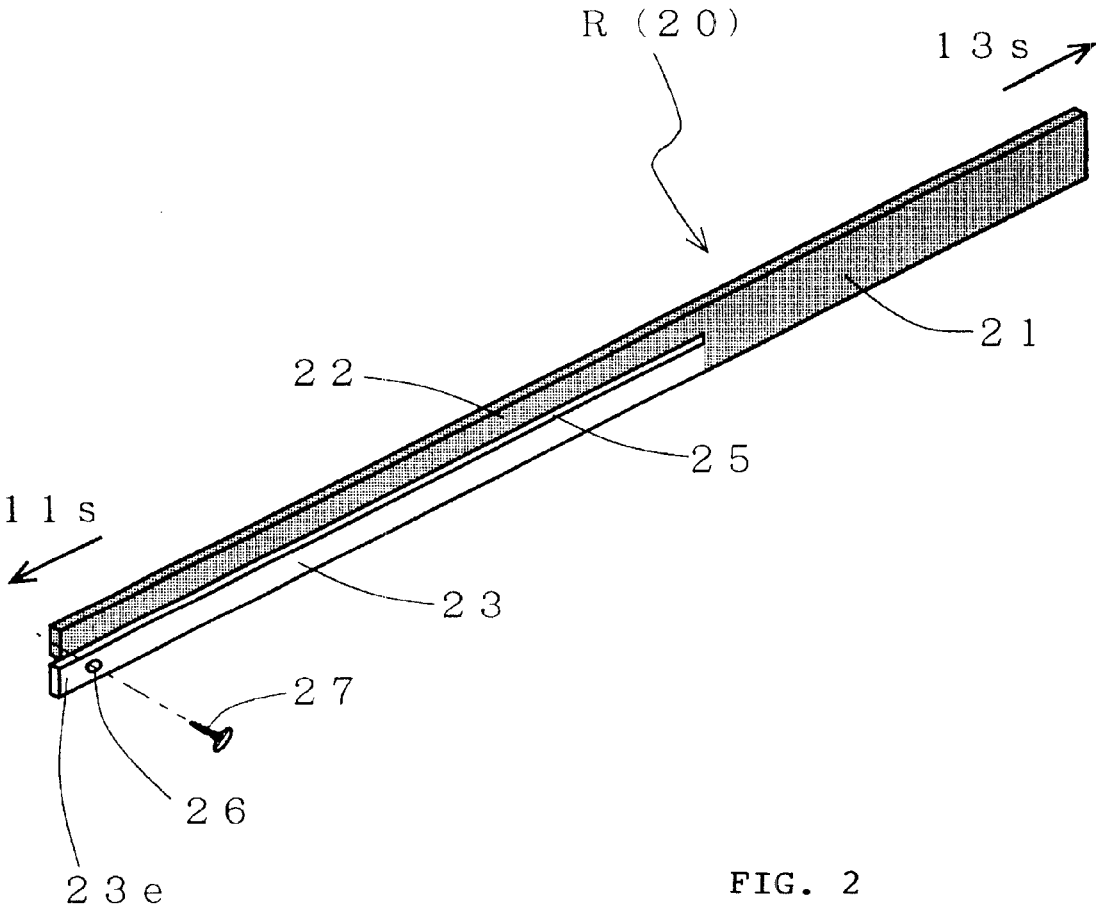
FIG. 2 is an isometric view of a plate bar-shaped body of a reinforcing element in accordance with this invention.

An example of the plate bar-shaped body R is shown at 20 in FIG. 2. It is comprised of a material having rigidity with a high Young's modulus like a metal plate or a carbon fiber material. The body 20 has a groove 25 cut in from the body side 11*s*, leaving a prescribed ungrooved part toward the head side 13*s*. The groove 25 divides the plate bar-shaped body into an instrument head-side grooveless part 21 to the right in FIG. 2, an instrument body-side groove upper part 22 and an instrument body-side groove lower part 23, both to the left in FIG. 2. The groove 25 may divide the body in half, top and bottom.

Figure 3:
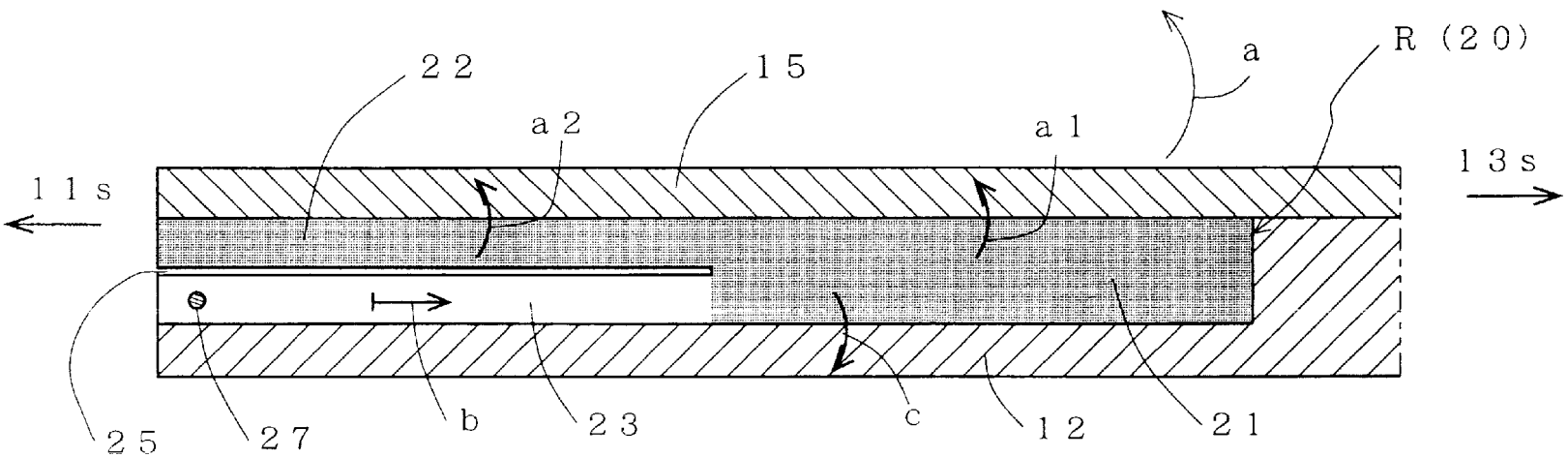
FIG. 3 is a partial sectional view of the plate bar-shaped body as shown in FIG. 2.

The head-side grooveless part 21 and the body-side groove upper part 22 are integrally secured to the neck 12 along the entire length of the body. The body is inside the neck and the securement is to the underside of the top side of the neck, here the underside of the finger board. The stippled indication in FIG. 3 shows the secured part. The body side terminal 23*e* of the body side groove lower part 23 along its entire length, is securely held to the neck 12 toward the body end of the part 23 without being integrally secured to the neck 12 along its entire length. There is a screw hole 26 in the body-side groove lower part 23. A fixing screw 27 is installed in the screw hole 26. That screw secures the part 23 to the neck.

When the plate bar-shaped body R (20) is placed under the bottom side of the finger plate 15 on the neck 12, the following functions occur. The head-side grooveless part 21 and the body-side groove upper part 22 are integrally bound to the neck 12, as shown in FIG. 3, to function as a strength preservation member for the neck 12. The neck 12 tends to bend upward under the tensile strength of the strings 19. In particular, the head side 13*s* experiences higher bending moments. The integrated part of the head-side grooveless part 21 and the body-side groove upper part 22 have high rigidity, as compared with the usually wooden material of the neck 12. They are fixed to the upper part of the neck 12 (that portion which is under the finger plate 15) at the head side 13*s*. As a result, the resistance to bending moments of the upper part of the neck 12 and the head side 13*s* increases.

The body-side groove lower part 23 that is situated below the neck 12 has a function which peculiarly reflects the material of the plate bar-shaped body 20, as it is not integrated with the neck 12. When the neck 12 tends to bend upward and deforms as shown by arrow a in FIG. 3, forces a1 and a2 operate on the head-side grooveless part 21 and on the body-side groove upper part 22 that are integrally secured to the neck 12 and they deform upward together with the neck 12. This produces a force b in the body-side lower part 23 to extend in the longitudinal direction away from the fixed screw 27 which is a fixed part. This force b tends to at least partially compensate for upwardly directed forces a1 and a2.

Since the plate bar-shaped body 20 is more rigid than the wooden material of the neck 12, there is no significant elongation of the neck. Rather, the neck supplies force that prevents the forces a1 and a2 for upward deformation that works on the head-side grooveless part 21 and the body-side groove upper half part 22 or as a drag c in a direction which is opposite to that of the force a for upward deformation.

Therefore, the plate bar-shaped body R (20) reinforces because of its material rigidity and also reinforces by supplying a mechanical drag, thereby creating a reinforcing structure for avoiding bending of the neck, using a simple structure offering high strength.

Figure 7:
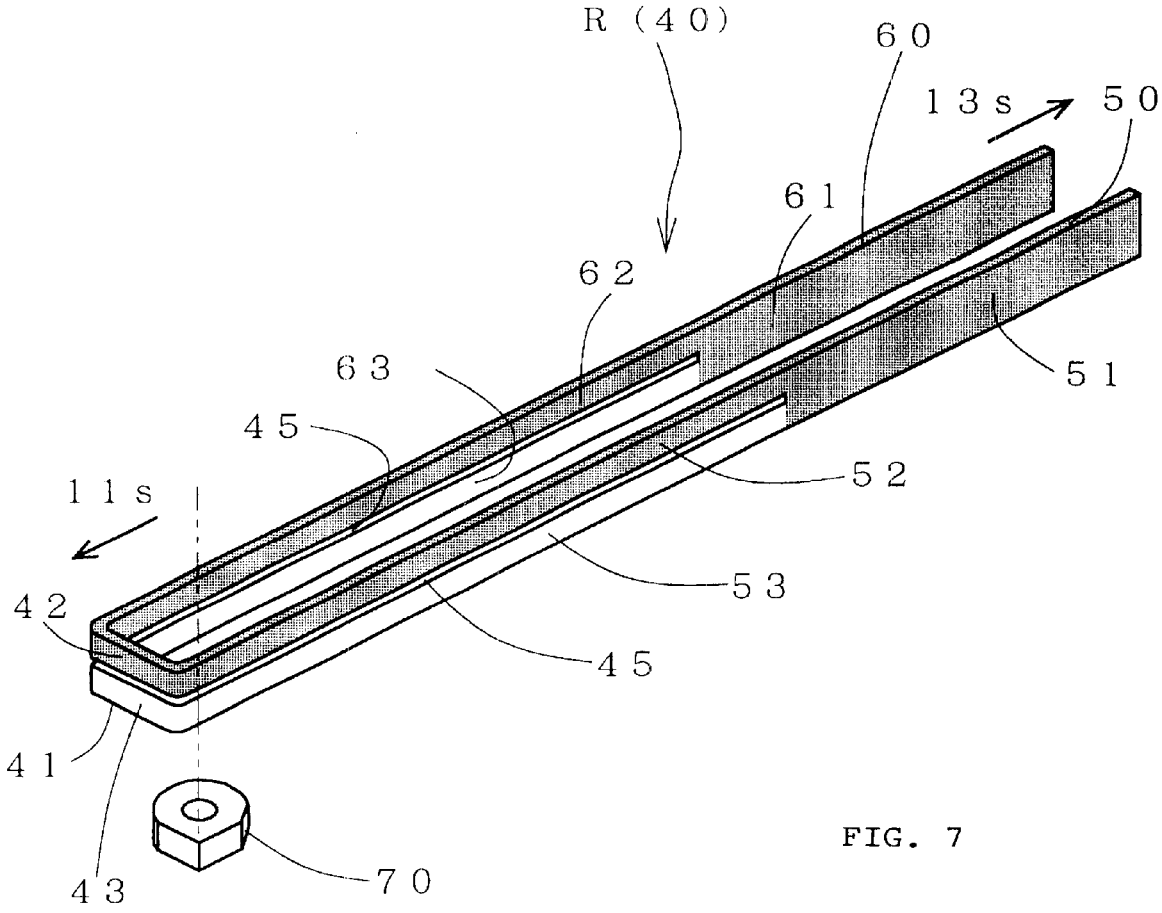
FIG. 7 is an isometric view of another embodiment of the plate bar-shaped body according to the invention.

Another embodiment of the invention is now explained. The plate bar-shaped body R (40) in FIG. 7 is formed approximately in a U-shape, as viewed in a plane that includes a right-side plate bar-shaped part 50 and a left side plate bar-shaped part 60 connected by the bent connector 41 on the instrument body side 11*s*. The plane of the body 40 is parallel to the top side of the neck.

Because the neck of a stringed instrument has some width, the entire neck can have a reinforced structure of higher strength by arranging two plate bar-shaped bodies 50 and 60 in parallel and extending along the longitudinal direction of the neck. It is possible to arrange two plate bar-shaped bodies 20 as shown in the example described above independently in parallel. However, it is advantageous from the standpoint of production and assembly to form a single member of U-shape, as viewed in the plane through the bent connector 41 on the body side 11*s*.

A cut groove 45 is formed through the body 40 extending from the bent connector 41 partially up both legs of the U-shape leaving a prescribed ungrooved part on the head side 13*s* opposite the bent connector 41 at the body side 11*s*. There is a head-side grooveless part 51 of the right-side plate bar-shaped part 50, a body-side groove upper part 52 of the right side plate bar-shaped body 50, a body side groove lower part 53 of the right-side plate bar-shaped body 50, a head-side grooveless part 61 of the left-side plate bar-shaped part 60, a body-side groove upper part 62 of the left-side plate bar-shaped part 60, a body-side groove lower part 63 of the left-side plate bar-shaped part 60. There is a bent connector groove upper part 42 and a bent connector groove lower part 43.

In the manner described earlier, the head-side grooveless parts 51 and 61, the body-side groove upper parts 52 and 62 and the bent area 42 (stippled in the drawing) are secured integrally as one body to the underside of the top side of the neck. The body-side groove lower parts 53 and 63 and the bent area 43 of the body-side terminal bent connector 41 are securely held by the neck 12 without being integrally secured to the neck. A cam 70 (described below) serves as a fixing member. The functions of the above described parts of the body 40 are the same as those described earlier.

Figure 8:
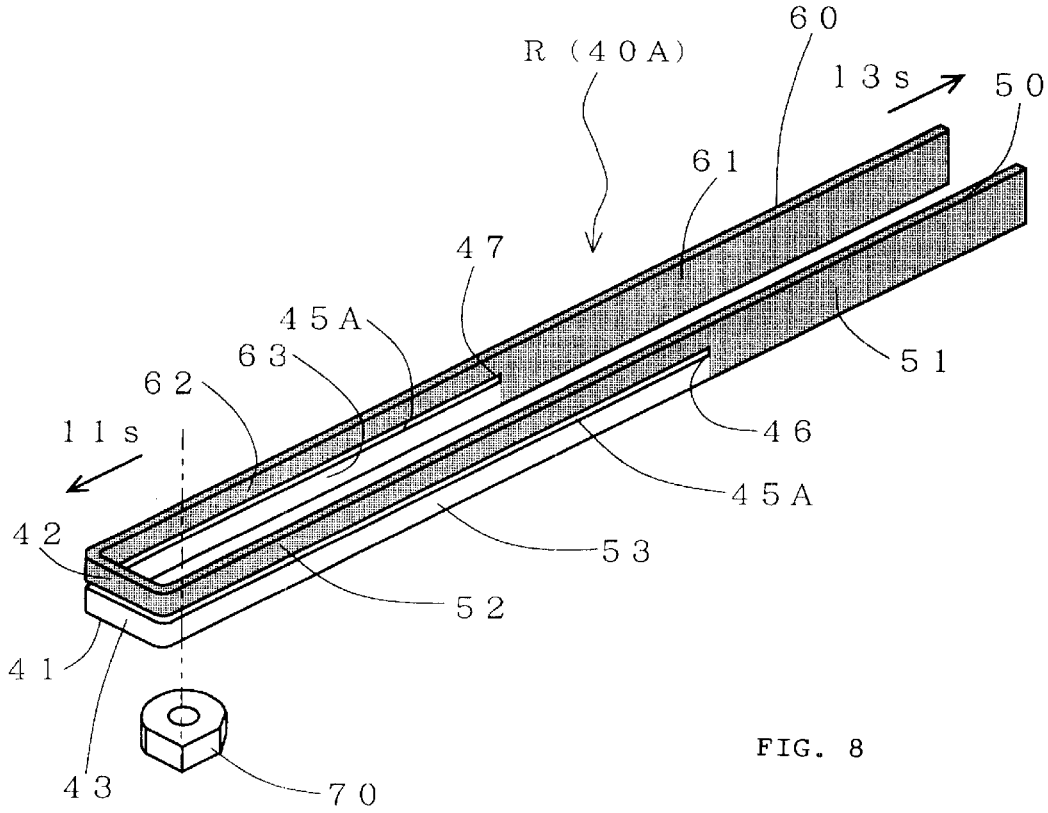
FIG. 8 is an isometric view of still another embodiment of the plate bar-shaped body in accordance with the invention.

FIG. 8 illustrates another modification of a body R (40A). The terminal positions 46 and 47 of the cut grooves 45A of the right-side plate bar-shaped part 50 and the left-side plate bar-shaped part 60 are at different positions along their parts of the body from their head-sides 13*s*. Strings 19 on a stringed instrument are thick on the lower pitch sound side, and thinner on the higher pitch sound side, so that the tensile forces applied by the strings are different between the right and left sides across the guitar. The right-side part 50 which is juxtaposed with thicker strings 19 has a longer cut groove than the left side part 60.

Those members in FIG. 8 which are the same as in FIG. 7 have the same reference numerals and their explanations are omitted.

In another aspect of the invention, the reinforcing structure of the neck of a stringed instrument has a tensile means P that pulls the body-side lower parts (23, 53 and 63) to the body side 11*s* in the plate bar-shaped bodies R (20, 40 and 40A).

Figure 4:
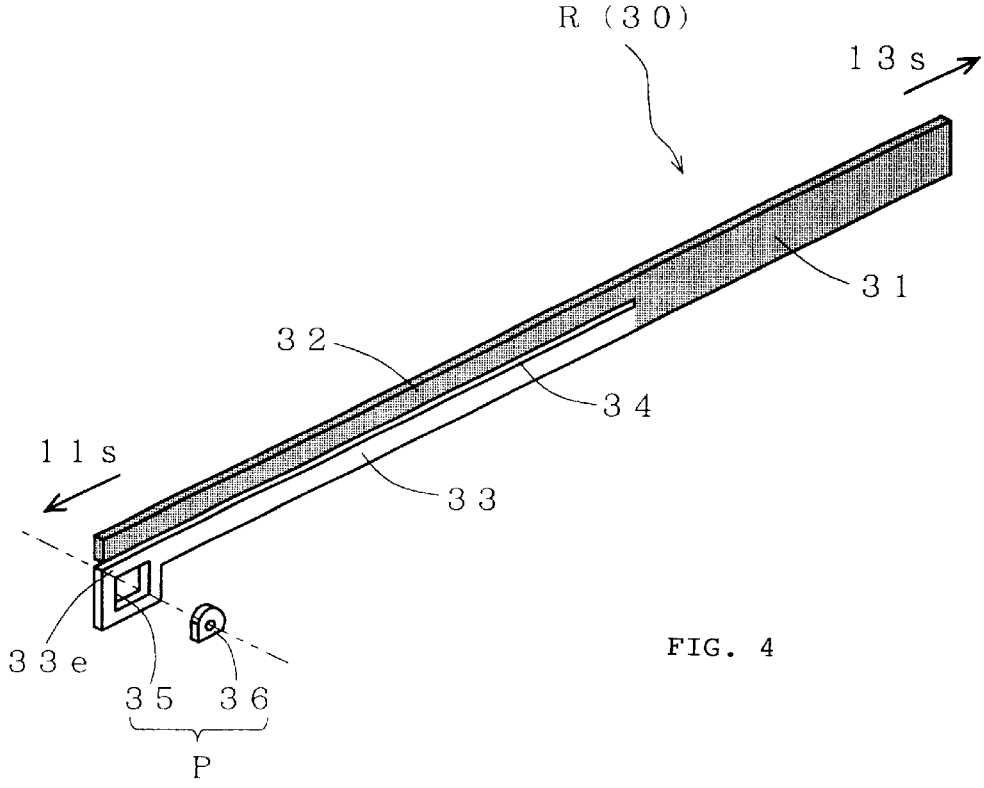
FIG. 4 is an exploded perspective view of the plate-bar-shaped body of FIG. 2 with a tensile means.
Figure 5:
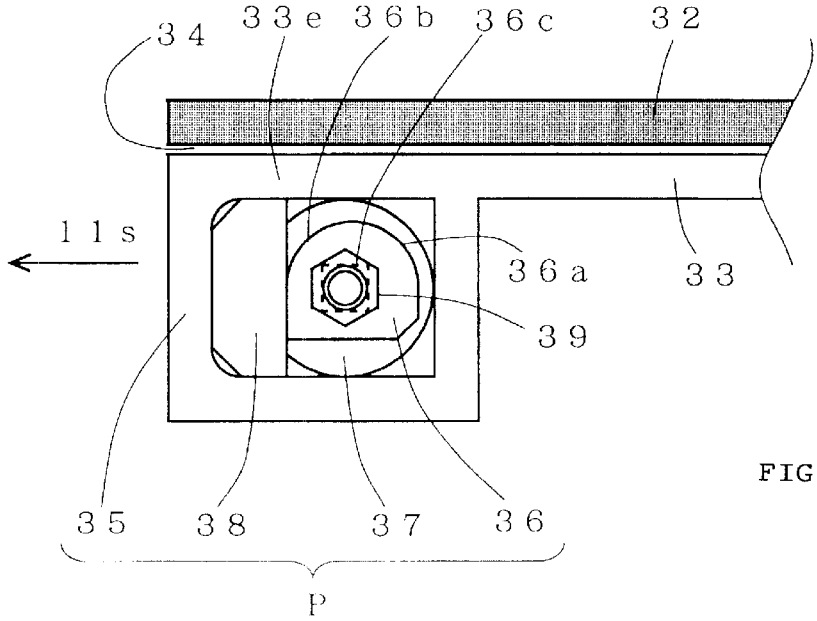
FIG. 5 is a side view of the tensile means shown in FIG. 4.
Figure 6:
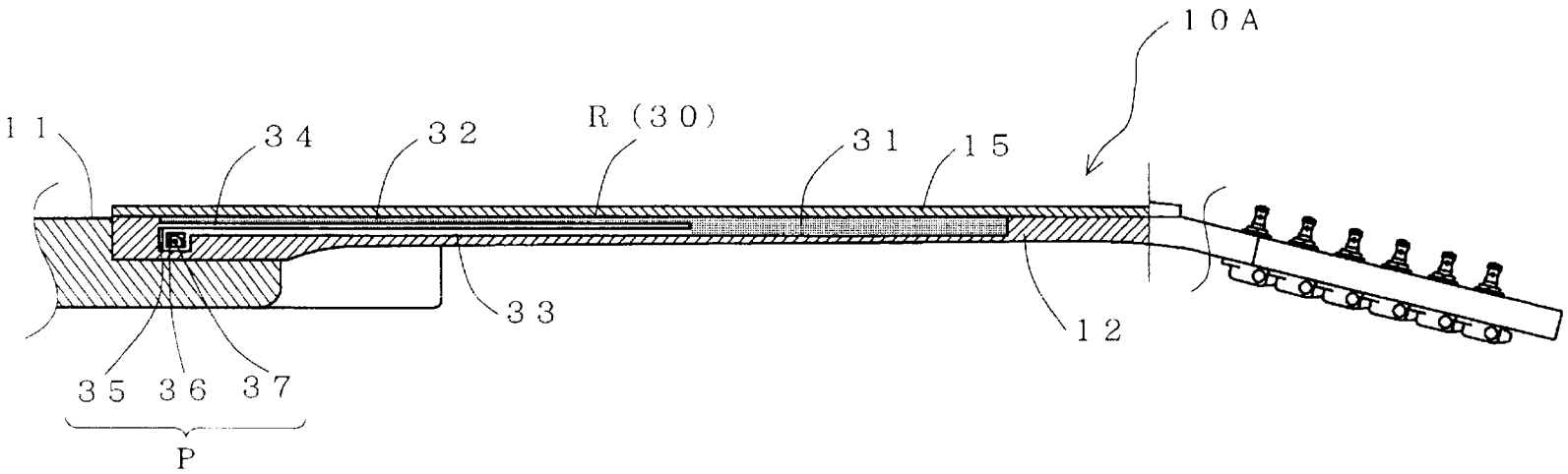
FIG. 6 is a section of the neck of an electric guitar incorporating the plate bar-shaped body shown in FIG. 4.
Figure 9:
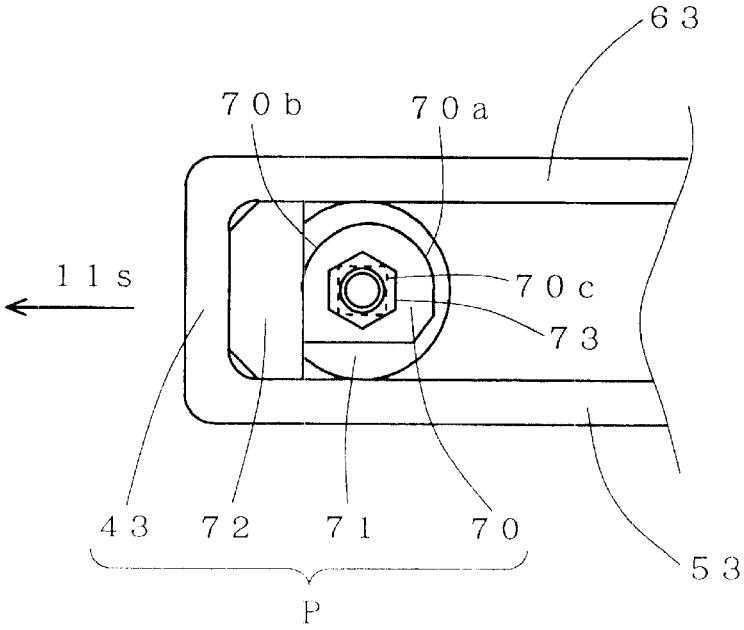
FIG. 9 is a partly expanded view of a fixed tensile means.
Figure 10:
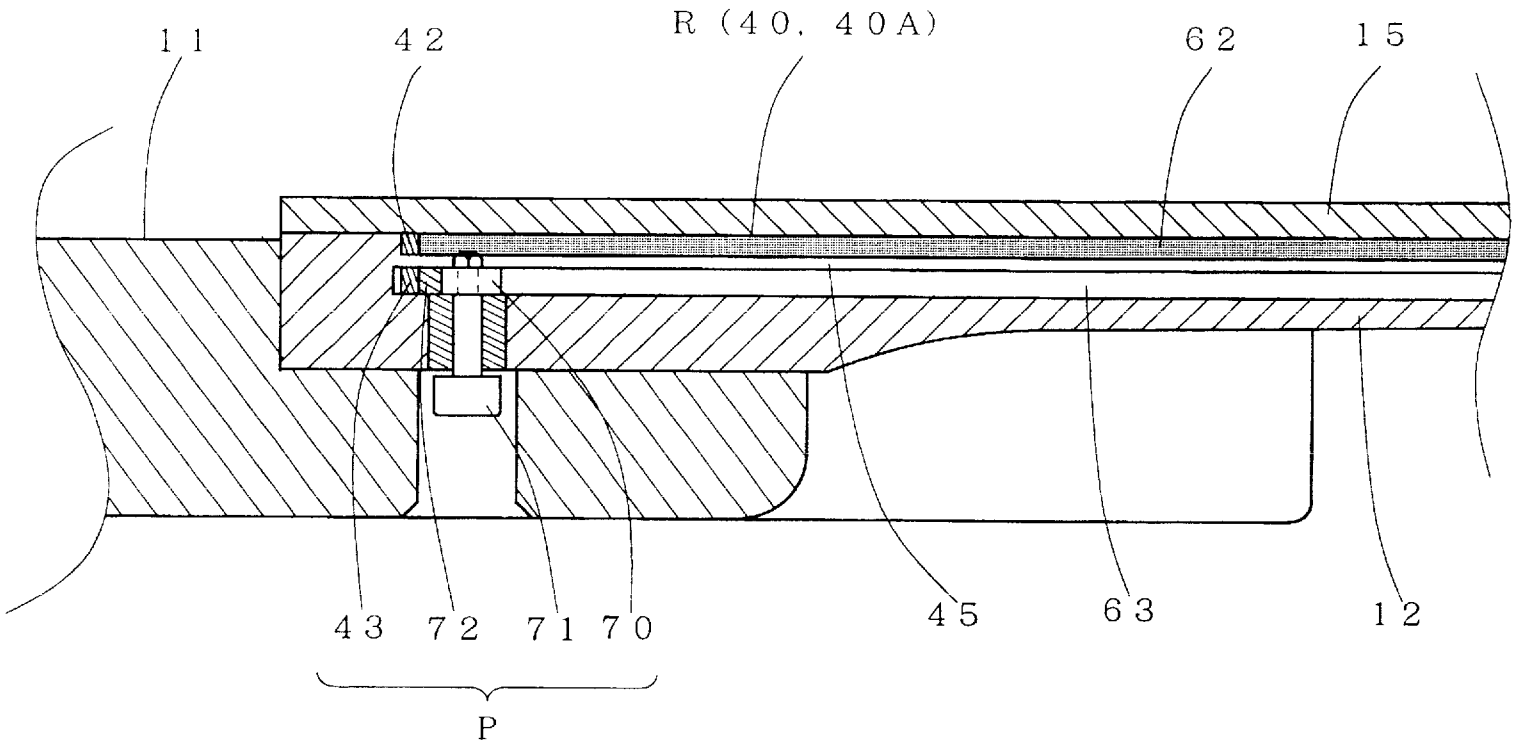
FIG. 10 is an elevated sectional view of the neck of an electric guitar incorporating the plate bar-shaped body shown in FIG. 7 or 8.

One example of the tensile means P of a plate bar-shaped body R (30) is shown in FIGS. 4 through 6. Another example of the tensile means P of the plate bar-shaped body R (40 or 40A) is shown in FIGS. 9 and 10.

In the tensile means P of one plate-bar-shaped body R (30) shown in FIG. 4, the plate bar-shaped body R (30) is divided into the head-side grooveless part 31, the body-side upper part 32 and the body-side lower part 33 by the cut groove 34, as described above. At the body-side 11*s* terminal 33*e* of the body-side groove lower part 33, a square-shaped cam mounting part 35 is formed. It receives an eccentric cam 36 that serves as a fixing member when installed in the cam mounting part 35 in a freely rotatable fashion.

The eccentric cam 36 has a large-diameter generally arcuate region 36*a* and a small-diameter generally arcuate region 36*b*, as shown in expanded view in FIG. 5. The cam is installed integrally on an installation member 37 through an installation hole 36*c* which is rectangular in shape. The difference between the large diameter region 36*a* and the small-diameter region 36*b* of the eccentric cam 36 in the example may be one millimeter. The installation member is in turn attached to the side wall of the recess in the neck that receives the body R (30). If the installation member 37 is rotated e.g., by a wrench (not shown), etc., which rotates the eccentric cam 36 by a prescribed angle, the large-diameter part 36*a* presses on the cam-receiving member 38 and pulls the body-side groove lower part 33 toward the body side 11*s* acting through the cam mount 35. A fixing nut 39 tightens the eccentric cam 36 and the installation member 37.

FIG. 6 shows a section of the neck 12 of a guitar 10A which incorporates the tensile means P. The eccentric cam 36 ordinarily functions as a fixing part on the body-side groove lower half part 33. When the eccentric cam 36 is operated in the manner described above, the body-side groove lower part 33 of the plate bar-shaped body R (30) may be pulled toward the body side 11*s*.

The tensile force applied by the tensile means P produces a drag force c in the plate bar-shaped body R (30) as described earlier and as shown in FIG. 3 and is a force that counters other forces that would tend to deform the neck 12 through the head-side grooveless part 31 and the body-side groove upper half part 32 integrally secured with the neck 12 of the instrument. An inevitable warp that develops in the neck 12 can thus be corrected and adjusted.

An example of the tensile means P of the plate bar-shaped body R (40 or 40A) of FIGS. 7–9 having a U-cross section is explained. In FIG. 9, because the body-side groove lower parts 53 and 63 of the plate bar-shaped body R (40, 40A) are linked by the bent connector groove lower part 43, the tensile means P is provided inside the bent connector groove lower part 43.

In this example, too, an eccentric cam 70 as described above is used. The eccentric cam 70 has a larger-diameter region 70*a* and a smaller-diameter region 70*b*. It is installed integrally on the installation member 71 at a rectangular installation hole 70*c*. As described earlier, when the installation member 71 is rotated, its large-diameter region 70*a* presses the cam-receiving member 72 and pulls the body-side groove lower parts 53 and 63 toward the body side 11*s* through the bent connector of the groove lower part 43. A fixing nut 73 secures the eccentric cam 70 to the installation member 71.

FIG. 10 shows an expanded section of the neck 12 of the guitar 10 incorporating the tensile means P of FIG. 9. The installation member 71 passes through the bottom of the guitar neck and secures the cam there. The eccentric cam 70 functions as a fixing member in ordinary cases. As the eccentric cam 70 is operated, it pulls on the body-side groove lower parts 53 and 63 of the plate bar-shaped body R (40, 40A) in the direction toward the body side 11*s*. As a result, the force that tends to deform the neck 12 upward is prevented through the head-side grooveless parts 51 and 61 and the body-side groove upper parts 52 and 62 that have been secured on the neck 12 of the guitar. Should an inevitable bend be produced in the neck 12, it could be corrected and adjusted.

Thus, the reinforcing structure for the neck of a stringed instrument in this invention, which has been explained above, makes it possible to achieve the reinforcement using a material having rigidity and from the standpoint of a drag in terms of dynamics by using an extremely simple structure.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A stringed instrument comprising:

an elongated neck having opposite neck ends and having a top side;

at least one string above the top side of the neck and attached to the instrument to be tensioned between the opposite neck ends and the string generating a tensile force which tends to deform the elongated neck; and an elongated, plate, bar-shaped body mounted to the elongated neck under the top side, the body having opposite first and second body ends along the neck;

an elongated groove extending in from the first body end, the groove terminating at a distance from the second body end to define a grooved end region of the body toward the first body end and an ungrooved end region of the body toward the second body end, the groove dividing the grooved end region into a first portion, which is below and spaced away from the top side of the neck, and a second portion, which is between the top side of the neck and the first portion;

the second portion of the grooved end region and the ungrooved end region of the body being fixed to the top side of the elongated neck along the length of the body;

the first portion of the grooved end region being adjustably attached to the elongated neck in a manner to generate a force which acts upon the elongated neck to minimize the deformation of the elongated neck.

2. The stringed instrument of claim 1, further comprising a finger plate attached at the top side of the elongated neck.

3. The stringed instrument of claim 2, wherein the second portion of the grooved end region and the ungrooved end region of the body are fixed to the finger plate.

4. The stringed instrument of claim 1, wherein the elongated neck has a recess below the top side of the neck and in which the elongated, plate, bar-shaped body is disposed; the recess in the neck being defined by another side of the neck than the top side and to which the end region of the first portion is attached.

5. The stringed instrument defied in claim 1, wherein the plate, bar-shaped body is made of material having a rigidity greater than that of material of the elongated neck.

6. The stringed instrument defied in claim 1, wherein the instrument has a body to which the neck is attached and the first body end of the bar shaped body is toward the body of the instrument.

7. The stringed instrument defined in claim 1, further comprising a second one of the elongated, plate, bar-shaped bodies received in the neck, the two plate, bar-shaped, bodies extending next to and parallel to one another; the second plate, bar-shaped, body also having a respective one of the grooves and the grooves in the two bodies extend into the bodies from the same direction from the first body ends.

8. The stringed instrument defined in claim 7, further comprising a connector joining the first body ends of both of the elongated, plate, bar-shaped bodies thereby forming a U-shape of the two bodies and the connector, a groove also extending through the connector and through the first body ends, and the respective grooves in the two bodies terminating at a distance from the second body ends of the plate, bar-shaped, bodies.

9. The stringed instrument defined in claim 8, wherein the respective grooves terminate at the same distance from the second body ends of the two plate, bar-shaped bodies.

10. The stringed instrument defined in claim 8, wherein the respective grooves terminate at different distances from the second body ends of each of the two plate, bar-shaped bodies.

11. The stringed instrument defined in claim 8, wherein the instrument has a body to which the neck is attached and the first body end of the bar shaped body is toward the body of the instrument.

12. The stringed instrument defined in claim 1, further comprising a mounting part on the first portion at the first body end of the plate, bar-shaped body; and a rotatable cam contacting the mounting part, the cam being supported in the neck and being shaped such that rotation of the cam causes the cam to exert a force that urges the first portion of the plate, bar-shaped, rigid body toward one of the opposite neck ends.

13. The string instrument of claim 12, wherein the eccentric cam is displaceable between angular rotation positions for urging the first body portion toward one of the neck ends.

14. The stringed instrument of claim 12, wherein the mounting part has a surface which contacts the cam;

an installation member for the eccentric cam, and a tightening element which prevents angular displacement of the installation member and the eccentric cam relative to one another upon installing the eccentric cam at the installation member, the installation member being sized and shaped to rotate with respect to the mounting part upon applying an external torque to the tightening element for causing the cam to apply force to the mounting part.

15. A stringed instrument, comprising:

an elongated neck having opposite neck ends and a top side;

at least one string stretched between the opposite neck ends and above the top side and generating a tensile force which tends to deform the elongated neck in one direction;

a reinforcing body placed in the elongated neck under the top side and having first and second opposite body ends toward the opposite neck ends, respectively;

the first body end having a groove which extends toward the second body end and terminates at a distance therefrom, so that the groove divides the first body end into a first portion spaced from the at least one string and a second portion located between the at least one string and the first portion, the second body end being ungrooved;

the second portion and the second body end of the reinforcing body being fixed to the top side of the elongated neck along the length of the body;

the first portion of the one body end being attached to the elongated neck off the top side and in a manner to generate a counter force which acts upon the elongated neck in a direction opposite to the one direction to minimize the deformation of the elongated neck.

16. The stringed instrument defined in claim 15, wherein the body is made of material which is more rigid than material of the neck.

17. The stringed instrument defined in claim 16, further comprising a fastener extending through the first portion of the one end of the body and attachable to the elongated neck off the top side.

18. The stringed instrument defined in claim 6, wherein the instrument has a body to which the neck is attached and the first body end of the bar shaped body is toward the body of the instrument.

* * * * *